US007028782B2

(12) United States Patent
Richardson

(10) Patent No.: US 7,028,782 B2
(45) Date of Patent: Apr. 18, 2006

(54) SYSTEM AND METHOD FOR SUPPRESSING FIRES

(75) Inventor: Adam Tartar Richardson, Toronto (CA)

(73) Assignee: NZ Towers Inc., Toronto (CA)

( * ) Notice: Subject to any disclaimer, the term of this patent is extended or adjusted under 35 U.S.C. 154(b) by 0 days.

(21) Appl. No.: 10/286,590

(22) Filed: Nov. 1, 2002

(65) Prior Publication Data

US 2004/0089460 A1 May 13, 2004

(51) Int. Cl.
*A62C 35/02* (2006.01)
*A62C 8/00* (2006.01)
*A62C 2/00* (2006.01)

(52) U.S. Cl. ..... 169/28; 169/43; 169/44; 169/36; 169/27; 169/85; 169/46

(58) Field of Classification Search ..... 169/9, 169/11, 26, 28, 44–47, DIG. 3, 36, 27, 85
See application file for complete search history.

(56) References Cited

U.S. PATENT DOCUMENTS 4,601,344 A 7/1986 Reed, Jr. et al.
4,807,706 A 2/1989 Lambertsen et al.
5,038,866 A * 8/1991 Kern et al. ..... 169/28
5,520,826 A 5/1996 Reed, Jr. et al.
5,610,359 A 3/1997 Spector
5,845,933 A * 12/1998 Walker et al. ..... 280/741
5,865,257 A 2/1999 Kozyrev et al.
5,957,210 A * 9/1999 Cohrt et al. ..... 169/44
5,992,528 A * 11/1999 Parkinson et al. ..... 169/6
6,016,874 A 1/2000 Bennett
6,019,861 A * 2/2000 Canterberry et al. ..... 149/19.1
6,089,326 A 7/2000 Drakin
6,116,348 A 9/2000 Drakin
6,136,114 A 10/2000 Smith
6,257,341 B1 7/2001 Bennett
6,287,400 B1 9/2001 Burns et al.

OTHER PUBLICATIONS

International Search report for corresponding PCT application—5 pages—mailed Feb. 2, 2004.

* cited by examiner

*Primary Examiner*—Davis Hwu
(74) *Attorney, Agent, or Firm*—Roach Brown McCarthy & Gruber; Kevin D. McCarthy

(57) ABSTRACT

A method and apparatus for suppressing a fire utilizing non-azide solid gas propellant generation to produce and transport a suitable gas for suppressing a fire in a normally occupied area. The nitrogen gas produced by the solid propellant gas generation is optionally treated to remove undesirable elements such as water and/or carbon dioxide from the product gas prior to the delivery of the product gas to the protected hazard area.

14 Claims, 2 Drawing Sheets

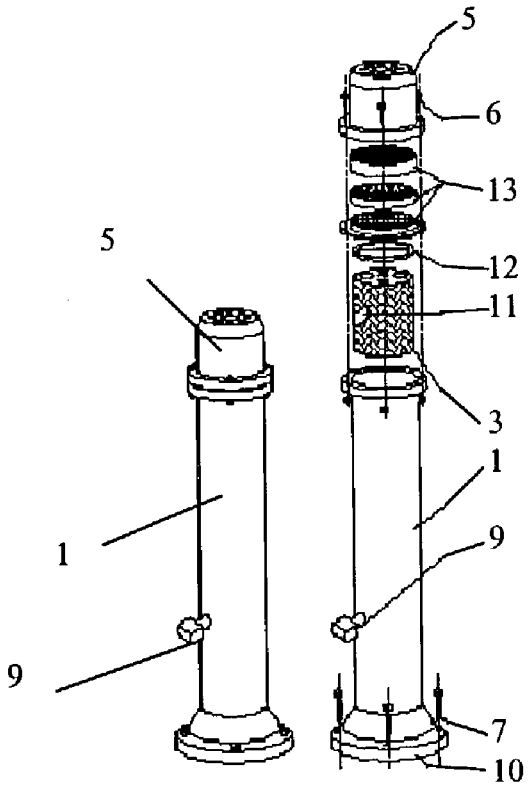
Figure 1B
Figure 1A
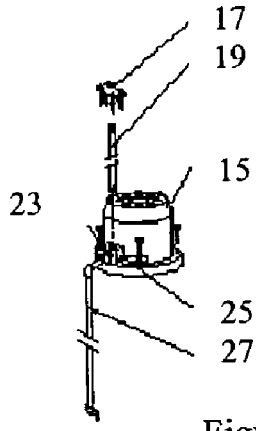
Figure 2A
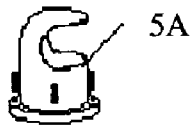
Figure 2B
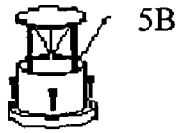
Figure 2C
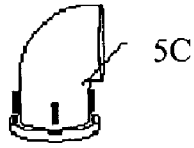
Figure 2D

SYSTEM AND METHOD FOR SUPPRESSING FIRES

BACKGROUND OF THE INVENTION

1. Field of the Invention

The present invention is directed to a system and method for suppressing fires in normally occupied areas utilizing non-azide solid propellant inert gas generators. In one aspect, this invention relates to the use of solid propellant inert gas generators for suppressing fires in occupied spaces whereby human life can still be supported in those spaces for a period of time.

2. Description of the Related Art

Numerous systems and methods for extinguishing fires in a building have been developed. Historically, the most common method of fire suppression has been the use of sprinkler systems to spray water into a building for cooling the fire and wetting additional fuel that the fire requires to propagate. One problem with this approach is the damage that is caused by the water to the contents of the occupied space.

Another method is the dispersal of gases, such as nitrogen, to displace oxygen in an enclosed space and thereby terminate a fire while still rendering the enclosed space safe for human occupancy for a period of time. For example, U.S. Pat. No. 4,601,344, issued to The Secretary of the Navy, discloses a method of using a glycidyl azide polymer composition and a high nitrogen solid additive to generate nitrogen gas for use in suppressing fires. The problem with the method disclosed in U.S. Pat. No. 4,601,344 is that azide compositions are used, which potentially may be harmful to human health and which typically generate less gas by weight relative to non-azide compositions.

Yet another method is the dispersal of gases, such as Halon 1301, to chemically suppress a fire. These systems store the Halon 1301 gas in a liquid state under pressure in compressed gas cylinders. Typically, a plurality of such cylinders is required for a single small building. The use and maintenance of compressed gas cylinders is expensive. Further, they are often stored in a separate location in the building, thereby detracting from the usable floor space in a building.

Due to their use of ozone depleting greenhouse gases, Halon 1301 systems are being replaced by more environmentally friendly alternative systems, as mandated by the 1987 Montreal and 1997 Kyoto International Protocols. One example of a Halon 1301 alternative system uses HFC (e.g. FM-200 Fire Suppression System manufactured by Kidde Fire Systems), while others use an inert gas mixture (e.g. Inergen Fire Suppression System manufactured by Ansul Incorporated, or the system set forth in U.S. Pat. No. 4,807,706 issued to Air Products and Chemicals Inc.)

One disadvantage of such Halon 1301 alternate systems, is that they require substantially more fire suppression agent/gas on a lb per lb ratio than Halon 1301 (and therefore even more compressed gas cylinders) to produce the same performance. These new Halon 1301 alternative systems also require the use of high pressure piping and nozzle delivery systems to transport the agent to the protected area. This increases the cost of the system.

The existing ubiquitous Halon 1301 systems are used in North America for asset protection in high risk areas, such as electrical transformer vaults, airport control towers, computer rooms, telephone switch gear enclosures, etc., which operate 24 hours per day. In order to install a Halon 1301 alternative system which, as indicated above, uses discharge piping and nozzles, requires the end user of these systems to shut down the equipment (i.e. assets) being protected in order to install the alternative system. Such shut down procedures can be expensive.

U.S. Pat. Nos. 6,016,874 and 6,257,341 (Bennett) disclose the use of a dischargeable container having self-contained therein an inert gas composition. A discharge valve controls the flow of the gas composition from the closed container into a conduit. A solid propellant is ignited by an electric squib and burns thereby generating nitrogen gas. The propellant is said to be a mixture of sodium azide and sulphur which, as indicated above, can be harmful to human health.

Non-azide solid propellants are known in the art for inflating air bags and actuating seatbelt pretensioners in passenger-restraint devices, such as described in U.S. Pat. Nos. 5,520,826 (Reed Jr. et al) and 6,287,400 (Burns et al). However, there is no discussion in the art of using non-azide compositions in a system, which does not contain any compressed gas containers and piping, for extinguishing fires in normally occupied spaces.

SUMMARY OF THE INVENTION

It is an aspect of the present invention to provide a system and method for suppressing fires, which does not require the use of compressed gas cylinders, piping and nozzle delivery systems. According to one aspect of the invention, at least one non-azide solid gas propellant is used to generate gases to extinguish a fire. As discussed in greater detail below, the solid gas propellant is housed within a tower system that requires no piping, thereby resulting in minimal "down time" of the customer's assets (i.e. equipment) being protected, during replacement of existing Halon 1301 systems. Minimal down time during the replacement of existing Halon 1301 systems means substantial cost savings to the owner of these systems. Also, the towers of the present invention do not have to be removed from the location they are protecting in order to be recharged. Rather, the inventive system may be recharged on site through the use of prepacked non-azide propellant generators. The system is preferably operated to permit human life to be maintained for a period of time (e.g. by maintaining a sufficient mix of gases in the building to permit human habitation for a period of time while still being useful for suppressing fires).

One advantage of the instant invention is that, due to the use of non-azide solid propellant gas generators to suppress a fire, instead of compressed gas cylinders and a piping discharge system, the cost of installation of the system is dramatically reduced. A further advantage is that, without the use of compressed gas cylinders, the solid gas generators need not be stored in one location and connected to a distribution piping system extending throughout a building.

Instead, the fire suppression system may comprise a plurality of independent assemblies, each of which comprises at least one solid gas generator positioned in the enclosure where the gas will be required to extinguish a fire. Thus a fire suppression system for a building may be constructed without installing a piping system extending throughout an entire building.

In accordance with the instant invention, there is provided a method of suppressing fires in a space comprising the steps of generating a first suppressing gas mixture from at least one solid chemical non-azide propellant, the first suppressing gas mixture comprising at least a first gas (100% nitrogen), may include a second gas (100% water vapor), and/or third gas (100% carbon dioxide); filtering at least a percentage of the second and or third gas from the first fire suppressing gas mixture to produce a second fire suppressing gas mixture; and delivering the second fire suppressing gas mixture into the area which is to be protected.

In one embodiment, the first gas is 100% nitrogen. In another embodiment, the second gas will comprise 100% water vapor. In another embodiment the third gas is 100% CO2.

In another embodiment, substantially all of the second gas and/or third gas is filtered from the first fire suppressing gas mixture prior to the delivery of the fire suppressing gas mixture into the space (area).

The suppressing gas mixture permits the space to be habitable by human life for a predetermined time. Preferably, the predetermined time ranges from about one to five minutes, as per the requirements of the National Fire Prevention Association's 2001 standard for clean agent Halon 1301 alternatives.

In accordance with the instant invention, there is also provided an apparatus for suppressing fires in a normally occupied area. The apparatus comprises a sensor for detecting a fire; a control panel; and at least one solid pre-packed non-azide propellant gas generator for generating a fire suppression gas upon receiving a signal from the sensor and control panel, thus generating the fire suppression gas in the enclosure. The concentration of gas in the normally occupied area after delivery/generation of the fire suppression gas permits the normally occupied area to be habitable by human life for a predetermined time.

In one embodiment, the suppressing gas comprises at least two and/or three gases and the apparatus further comprises at least one filter and screen for filtering a portion of two of the gases from the fire suppression gas and reducing the heat of the gas generated prior to the delivery of the fire suppressing gas to the normally occupied area. The filter(s) may be adapted to filter substantially all of the second and/or third gases from the fire suppressing gas mixture.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1A shows an assembled gas generator fire suppression tower according to the preferred embodiment.

FIG. 1 B is an exploded view of the fire suppression tower of FIG. 1A.

FIG. 2A shows electrical connections to a diffuser cap of the tower in FIGS. 1A and 1B.

FIGS. 2B–2D show alternative embodiments of diffuser caps for use with the gas generator fire suppression tower of FIGS. 1A and 1B.

DETAILED DESCRIPTION OF THE PREFERRED EMBODIMENTS

Figure 3:
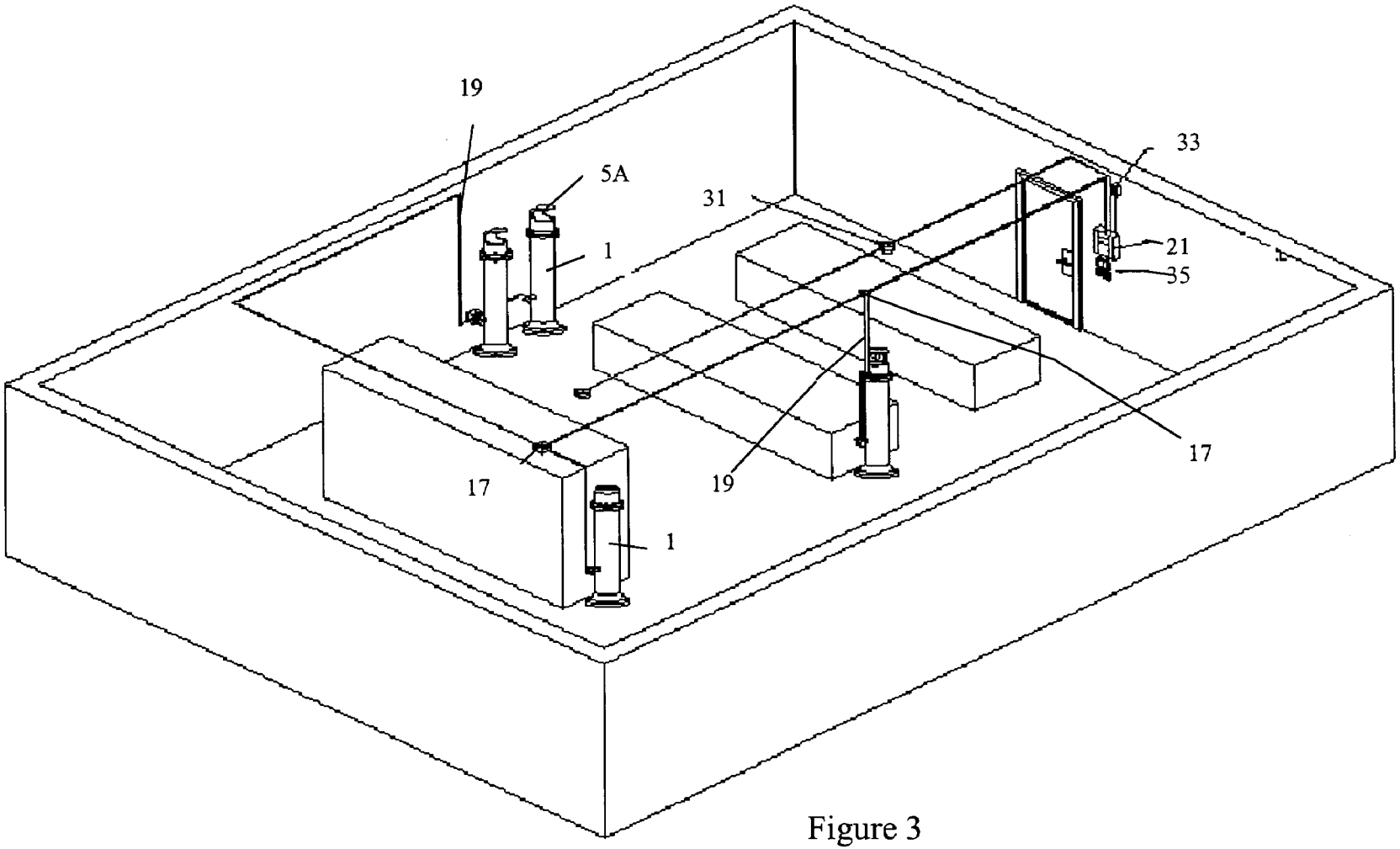
FIG. 3 is a schematic view of an enclosed space protected using the gas generator fire suppression towers of the present invention.

According to the present invention, a pre-packed solid gas generator is used for generating a gas mixture that is suitable for suppressing a fire from a solid non-azide chemical. Preferably, the solid chemical (not shown) used in the solid gas generator(s) may be similar to those used as gas generators for automobile air bags. The solid chemical does not contain azides. Azide compositions can be regarded as harmful to human health, and furthermore, often generate less gas by weight relative to non-azide compositions. Newer generation automotive air bags for cars utilize such non-azide systems and any of these may be used in solid gas generators.

In operation, solid gas generators produce an inert or near inert gas such as nitrogen, which reduces the concentration of oxygen in a room below the level that will sustain combustion. However, the oxygen concentration is maintained at a sufficient level to meet the requirements of the National Fire Prevention Association's 2001 standard for clean agent Halon 1301 alternatives in normally occupied areas.

As shown in FIGS. 1A and 1B, a gas generator fire suppression tower 1 is provided containing a pre-packed non-azide solid propellant canister 3 and a discharge diffuser 5 for discharging generated gases. The tower 1 is secured in position by floor mounting bolts 7 passing through a mounting flange 10, or any other suitable means. The diffuser 5 is likewise secured to the tower 1 using flange bolts with nuts 6.

A pyrotechnic device 9 (i.e. a squib) is attached to the pre-packed canister 3 by way of a connector 11, and to a fire detection and release control panel discussed in greater detail with reference to FIGS. 2A and 3. The squib is used to initiate the inert gas generation in response to electrical activation.

A propellant retainer 12 is provided along with various optional filters and/or screens 13, as discussed in greater detail below.

Turning to FIG. 2A in combination with FIG. 3, the discharge diffuser 5 is shown having a perforated cap 15. A raceway ceiling mounting foot 17 is provided for securing a conduit/wiring raceway 19 (e.g. steel pipe) between the fire detection and release panel 21 (FIG. 3) and a conduit connection 23 on a bracket 25. The conduit continues downwardly to the squib 9, as shown at 27.

FIGS. 2B–2D show alternative embodiments of discharge diffusers 5, for different installations of the tower 1, which may serve either as replacements for the perforated cap diffuser or be placed thereover. More particularly, FIG. 2B depicts a 180° directional diffuser cap 5A useful for installations wherein the tower is disposed along a wall. FIG. 2C depicts a 360° directional diffuser cap 5B useful for installations wherein the tower is centrally disposed. FIG. 2D depicts a 90° directional diffuser cap 5C useful for installations wherein the tower is disposed in a corner.

With reference to FIG. 3, a system is shown according to the present invention for suppressing fires in an enclosed space using a plurality of towers 1 as set forth in FIGS. 1 and 2. In operation, a sensor 31, upon detecting a fire, issues a signal to the control panel 21 which, in response, activates an alarm signaling device 33 (e.g. audible and/or visual alarm). Alternatively, an alarm may be initiated by activating a manual pull station 35. In response, the control panel 21 initiates a solid gas generator by igniting the pyrotechnic device 9, which in turn ignites the chemicals in the pre-packed canister 3 that produce the fire suppressing gas. The fire suppressing gas mixture preferably comprises nitrogen gas and may contain water vapor and/or carbon dioxide. However, as discussed above, the chemicals used in the solid gas generator do not contain azides.

As indicated above, the fire suppressing gas mixture may contain carbon dioxide and water vapor, which are optionally filtered using filters 13 (FIG. 1), resulting in the production of a filtered fire suppressing gas mixture. More particularly, the fire suppressing gas mixture may be filtered so that the gas introduced into the room (FIG. 3) contains from about zero to about five wt % carbon dioxide and preferably, from about zero to about three wt % carbon dioxide. More preferably, substantially all of the carbon dioxide in the mixture is filtered out of the mixture. The fire suppression gas mixture may also be filtered so that the gas introduced into the room will not form any substantial amount of liquid water when introduced into the environment of the fire. Preferably, the concentration of water vapor in the environment of the fire is maintained so that the water vapor is maintained above its dew point. Moreover, screens may be used to reduce the temperature of the fire suppressing gas generated as a result of igniting the pre-packed canister 3. Although the filters and screen(s) 13 are shown as being separate from the pre-packed canister 3, it is contemplated that at least the screen(s) may be incorporated as part of the canister structure.

Since there is no requirement to use compressed gas cylinders, discharge piping and discharge nozzles for the supply or transport of an extinguishing gas mixture, the system of FIG. 3 enjoys several advantages over the known prior art. Firstly, the use of only non-azide solid gas generators allows large amounts of gases to be generated with relatively low storage requirements. This reduces the cost of the system, making it more attractive to retrofit existing Halon 1301 systems with environmentally acceptable alternatives (i.e. inert or near-inert gasses are characterized as being zero ozone depleting and have zero or near-zero global warming potential).

Secondly, the system benefits from simplified installation and control since all of the solid gas generators need not be provided at one central location. Instead, one or more solid gas generators or towers 1 are preferably positioned at the location where the fire will have to be suppressed. In this way, the generation of fire suppressing gases within the hazard area, substantially simplifies the delivery of the gases without the need of a piping system extending throughout a building or perhaps through one or two walls.

Thirdly, the provision of independently positioned towers 1 results in the gas being generated and delivered to the hazard area almost instantaneously as it is released. This increases the response time of the fire suppressing system and it's ability to inert the hazard area and suppress the fire in a normally occupied area. Each solid gas generator 1 is preferably designed to generate a quantity of gas needed to extinguish a fire in room, should the need arise.

The filtered fire suppressing gas mixture is delivered into the room (FIG. 3) containing a fire. The volume of filtered fire suppressing gas to be delivered into the room depends on the size of the room. Preferably, enough of the filtered fire suppressing gas mixture is delivered into the room to suppress any fire in the room, yet still permit the room to be habitable by human life for a predetermined time. More preferably, a volume of filtered fire suppressing gas mixture is delivered into the room that permits the room to be habitable by human life for approximately one to five minutes, and more preferably from three to five minutes, as per the requirements of the National Fire Prevention Association's 2001 standard for Halon 1301 clean agent alternatives in normally occupied areas.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of suppressing fires in a space comprising the steps of:

(a) generating a first fire suppressing gas mixture from at least one non-azide solid propellant chemical, the first fire suppressing gas mixture comprising nitrogen and at least one of moisture and carbon dioxide, (b) filtering at least a percentage of said at least one of moisture and carbon dioxide from the first fire suppressing gas mixture to produce a second fire suppressing gas mixture; and (c) delivering the second fire suppressing gas mixture into the space.

2. The method as claimed in claim 1 wherein the first gas is nitrogen.

3. The method as claimed in claim 2 wherein the second gas comprises water vapor.

4. The method as claimed in claim 3 wherein the third gas is $CO_2$.

5. The method as claimed in claim 1 wherein substantially all of the second gas is filtered from the first fire suppressing gas mixture in step (b).

6. The method as claimed in claim 5 wherein the predetermined time ranges from about one to five minutes.

7. The method as claimed in claim 1 further comprising the step of reducing the temperature of the second fire suppressing gas mixture.

8. The method as claimed in claim 1 wherein the solid propellant chemical is azide free.

9. A gas generator for generating and delivering a fire suppressing gas mixture to an enclosed space, comprising:

a tower;

a pre-packed non-azide solid propellant canister disposed within said tower;

a pyrotechnic device for igniting said solid propellant canister and thereby generating said fire suppressing gas mixture;

a discharge diffuser for directing the fire suppressing gas mixture within said enclosed space;

and at least one filter for filtering at least a portion of one gas from said fire suppressing gas mixture.

10. The gas generator as claimed in claim 9, further comprising at least one screen for reducing the temperature of said fire suppressing gas mixture.

11. The gas generator as claimed in claim 9, wherein said discharge diffuser includes a 180° directional cap.

12. The gas generator as claimed in claim 9, wherein said discharge diffuser includes a 360° directional cap.

13. The gas generator as claimed in claim 9, wherein said discharge diffuser includes a perforated cap.

14. The gas generator as claimed in claim 9, wherein said discharge diffuser includes a 90° directional cap.

* * * * *

UNITED STATES PATENT AND TRADEMARK OFFICE

CERTIFICATE OF CORRECTION

PATENT NO. : 7,028,782 B2
APPLICATION NO. : 10/286590
DATED : April 18, 2006
INVENTOR(S) : Richardson It is certified that error appears in the above-identified patent and that said Letters Patent is hereby corrected as shown below:

On the cover sheet:
"(73) Assignee: NZ Towers Inc., Toronto (CA)" should read as --(73) Assignee: N2 Towers Inc., Toronto (CA)"--

Signed and Sealed this

Twenty-first Day of November, 2006

JON W. DUDAS
*Director of the United States Patent and Trademark Office*